US006994222B2

(12) United States Patent
Hunt

(10) Patent No.: US 6,994,222 B2
(45) Date of Patent: Feb. 7, 2006

(54) STORAGE DEVICE AND METHOD OF USING AND MAKING SAME

(75) Inventor: Thomas A. Hunt, Rancho Santa Fe, CA (US)

(73) Assignee: Spectrum Concepts, Inc., Carlsbad, CA (US)

( * ) Notice: Subject to any disclaimer, the term of this patent is extended or adjusted under 35 U.S.C. 154(b) by 21 days.

(21) Appl. No.: 10/408,008

(22) Filed: Apr. 4, 2003

(65) Prior Publication Data

US 2003/0192838 A1 Oct. 16, 2003

Related U.S. Application Data

(60) Provisional application No. 60/370,784, filed on Apr. 6, 2002.

(51) Int. Cl.
*A47G 29/00* (2006.01)

(52) U.S. Cl. ..... 211/40; 211/49.1; 211/183; 211/184

(58) Field of Classification Search ..... 211/40, 211/42, 49.1, 183, 184, 134, 135; 312/9.55, 312/9.1, 9.47, 9.53
See application file for complete search history.

(56) References Cited

U.S. PATENT DOCUMENTS

| | | | | | |
|---|---|---|---|---|---|
| 2,300,781 | A | * | 11/1942 | Gilley | 211/41.1 |
| 2,499,220 | A | * | 2/1950 | Hinsdale | 211/40 |
| 3,472,386 | A | * | 10/1969 | Osojnak | 211/40 |
| 3,554,381 | A | * | 1/1971 | Guest et al. | 211/11 |
| 3,603,460 | A | * | 9/1971 | Notes | 211/40 |
| 3,868,018 | A | * | 2/1975 | Thies | 211/40 |
| 3,889,812 | A | * | 6/1975 | Gutierrez | 211/1.51 |
| 3,966,050 | A | * | 6/1976 | Dahl | 211/10 |
| 4,312,548 | A | * | 1/1982 | Posso | 312/9.52 |
| 4,715,669 | A | * | 12/1987 | Baillie et al. | 312/9.52 |
| 4,819,813 | A | * | 4/1989 | Schubert | 211/40 |
| 5,027,955 | A | * | 7/1991 | Shoemaker, Jr. et al. | 211/40 |
| RE34,217 | E | * | 4/1993 | Edmark | 211/40 |
| 5,381,908 | A | * | 1/1995 | Hepp | 211/184 |
| 5,415,298 | A | * | 5/1995 | Callahan et al. | 211/40 |
| 5,558,235 | A | * | 9/1996 | Hunt | 211/40 |
| 5,632,374 | A | * | 5/1997 | Fitzsimmons et al. | 206/308.1 |
| 5,740,924 | A | * | 4/1998 | Hunt | 211/40 |
| 5,791,748 | A | * | 8/1998 | Marhefka | 312/9.48 |
| 5,794,796 | A | * | 8/1998 | Weisburn | 211/40 |
| 5,823,332 | A | * | 10/1998 | Clausen | 206/307.1 |
| 6,082,553 | A | * | 7/2000 | Stravitz | 211/40 |
| 6,279,757 | B1 | * | 8/2001 | Hayoun | 211/40 |
| 6,308,839 | B1 | * | 10/2001 | Steinberg et al. | 211/40 |
| 6,626,301 | B2 | * | 9/2003 | de Rouvray | 211/40 |
| 6,648,150 | B2 | * | 11/2003 | Hartstone | 211/40 |
| 6,758,346 | B2 | * | 7/2004 | Kollegian | 211/40 |
| 2003/0192837 | A1 | * | 10/2003 | Hunt | 211/40 |

* cited by examiner

*Primary Examiner*—Jennifer E. Novosad
(74) *Attorney, Agent, or Firm*—Duckor Spradling Metzger & Wynne; Bernard L. Kleinke

(57) ABSTRACT

A storage device and methods for supporting elements such as media packages, books and others, in an upright side-by-side configuration are disclosed. The device includes a body having an inclined element support surface having a sufficient incline to cause at least one of the elements to be biased to fall under the force of gravity toward one direction and align itself against a vertical surface.

24 Claims, 14 Drawing Sheets

STORAGE DEVICE AND METHOD OF USING AND MAKING SAME

RELATED APPLICATIONS

This application claims priority to U.S. provisional patent application entitled MEDIA SHELF AND METHOD OF USING SAME, Series No. 60/370,784, filed Apr. 6, 2002, and is incorporated herein by reference.

FIELD OF THE INVENTION

The invention relates to method and system for storing elements such as media. In particular, the invention relates to storage devices for storing elements in a side-by-side manner.

BACKGROUND ART

The information contained in this section relates to the background of the art of the present invention without any admission as to whether or not it legally constitutes prior art.

Various systems of media storage are known. For example, reference may be made to the following U.S. Pat. No. 2,300,781 to Gilley, U.S. Pat. No. 3,472,386 to Osojnak, U.S. Pat. No. 3,554,381 to Guest et al., U.S. Pat. No. 3,889,812 to Gutierrez, U.S. Pat. No. 3,966,050 to Dahl, U.S. Pat. No. 4,312,548 to Posso, U.S. Pat. No. 4,819,813 to Schubert, U.S. Pat. No. 5,027,955 to Shoemaker, U.S. Pat. No. 5,381,908 to Hepp, U.S. Pat. No. 5,558,235 to Hunt, U.S. Pat. No. 5,794,796 to Weisburn, and U.S. Pat. No. 5,823,332 to Clausen.

DESCRIPTION OF THE DRAWINGS

The following is a description of the drawings of certain embodiments of the present invention.

DETAILED DESCRIPTION OF CERTAIN EMBODIMENTS OF THE INVENTION

According to the disclosed embodiments of the present invention, there is provided a storage device for supporting elements such as media packages, books and others, in an upright side-by-side configuration. The device includes a body having an inclined element support surface having a sufficient incline to cause at least one of the elements to be biased to fall under the force of gravity toward one direction and align itself against a vertical surface.

According to one of the embodiments of the invention, the inclined surface may be upwardly curved in a convex manner. Alternatively, according to another embodiment of the invention, the inclined surface may be downwardly curved in a concave manner. According to another embodiment of the invention, the inclined surface may be a v-shaped surface having a pair of substantially flat inclined, intersecting surfaces. According to a still further embodiment, the inclined surface may be an inverted v-shaped surface. It will become apparent to those skilled in the art, that there may be compound surfaces including 2 or more of the curved or flat surfaces in accordance with the teachings relative to other embodiments of the invention.

Thus, the disclosed embodiments of the present invention enable elements to be supported conveniently in an upright manner by merely placing them on the storage device, which may serve as a shelf mounted in a cabinet, a furniture piece, or other, or may also be free standing, without the need of a movable book end or other such side support as additional elements are placed on the storage device. In this regard, as additional elements are added to the storage device, they automatically fall against previously stored adjacent elements under the force or gravity to assume an upright disposition automatically without the need of placing a book end or other side support against it.

Figure 1:
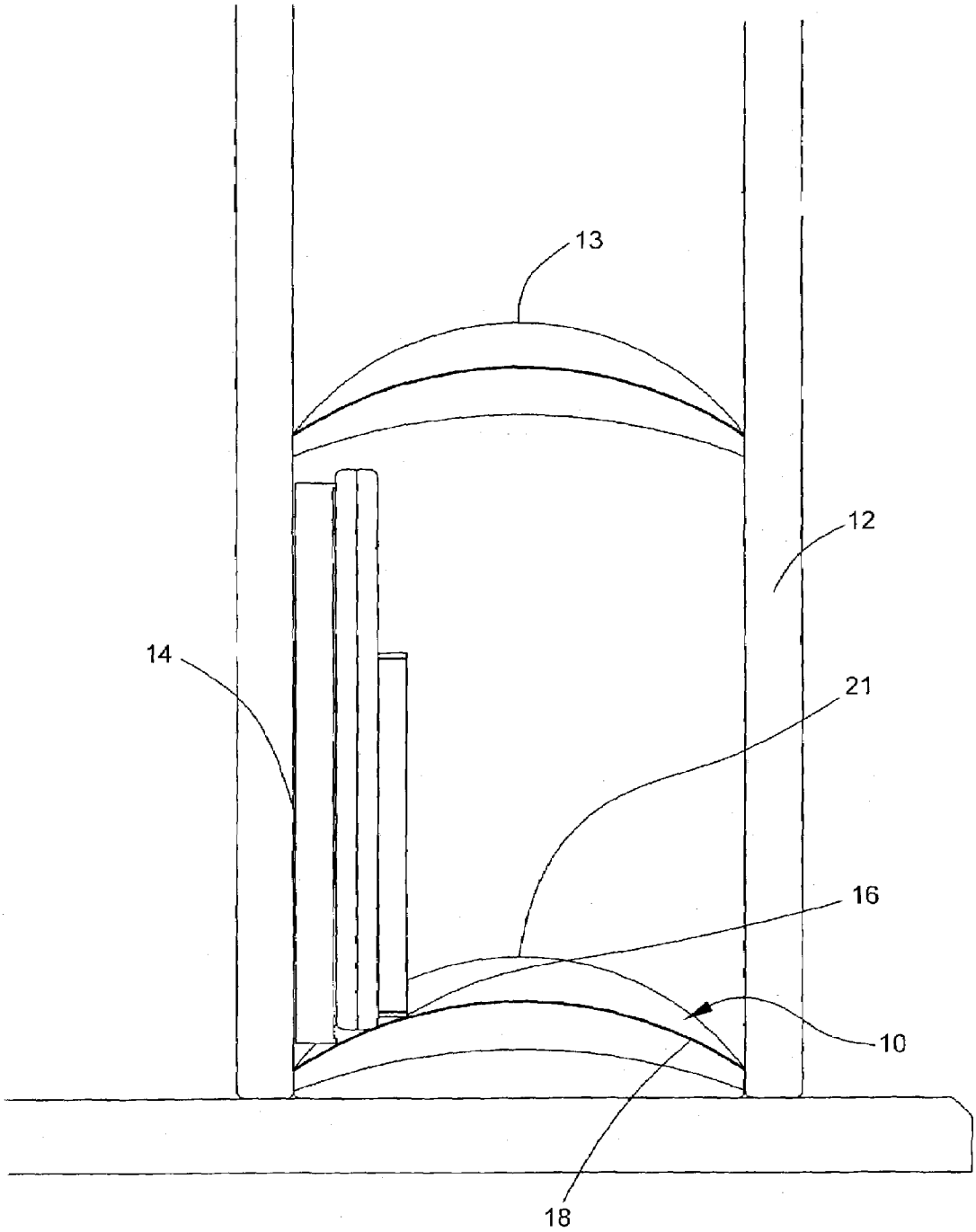
FIG. 1 is an elevational view of a storage device, which is constructed according to an embodiment of the invention, and which is illustrated mounted to a support structure.

Referring now to the drawings, FIGS. 1 through 7 illustrate a storage device 10 according to an embodiment of the present invention. The MEDIA SHELF device 10 may be adapted to be mounted onto a cabinet such as a cabinet 12 of a furniture unit (not shown). Elements such as a media package 14 may be stored on the device 10 serving as a media shelf within the cabinet or support structure 12. The media elements may be books, packages such as compact disc, DVD or video packages and others. FIG. 1 illustrates a frontal view of the storage device 10 with an identical device 13 mounted above it for additional storage.

The device 10 includes an inclined surface 16 on which elements may be stored in an upright side-by-side manner. As used herein, "upright" means a generally vertical disposition. As illustrated in FIG. 1, the surface is generally smoothly curved in an upwardly convex manner so that when the storage device 10 is mounted in a cabinet, the outside portions of the curved surface are lower than the central portion of the device. In this manner, media elements may be stored side-by-side with the bottom edges of the inner packages being higher than those of the outer packages, as illustrated clearly in FIG. 1.

The storage device 10 may also be provided with a front lip or flange 18 and a back lip or flange 21 to support the media packages in their stored position. It is noted that either one or both lips or flanges may be omitted if no front or back support is desired. For example, if the cabinet 12 is provided with a back support, the back flange 21 may be unnecessary.

Figure 3:
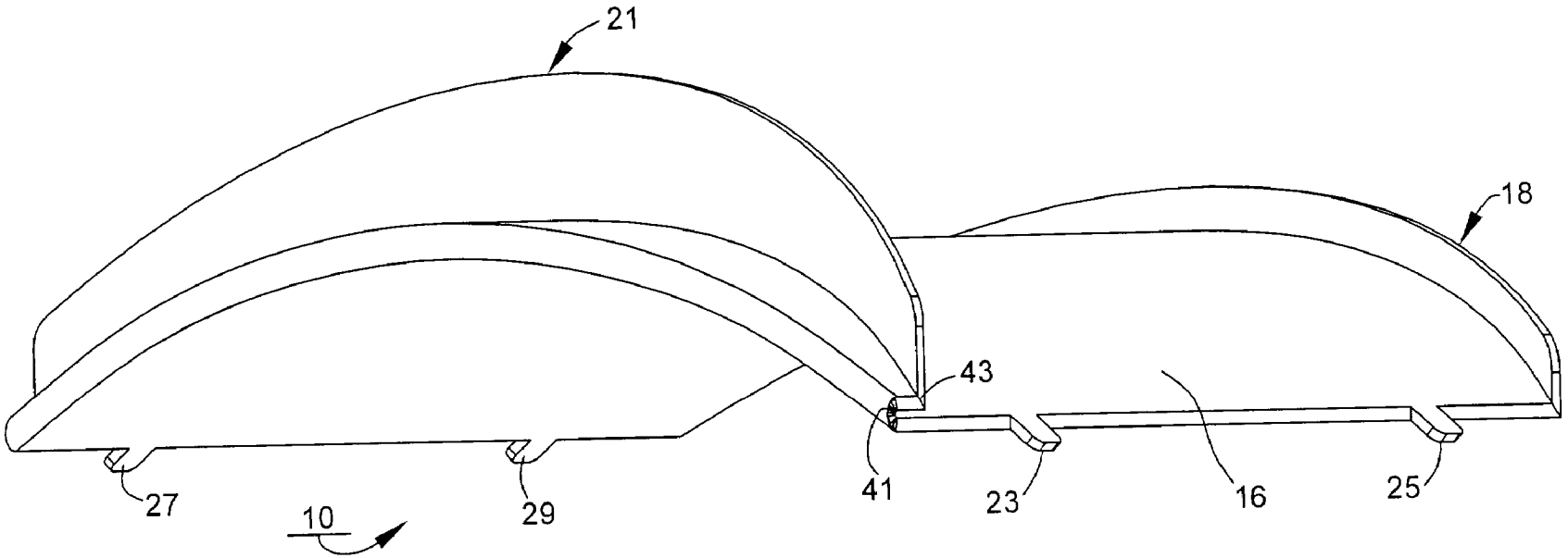
Figure 4:
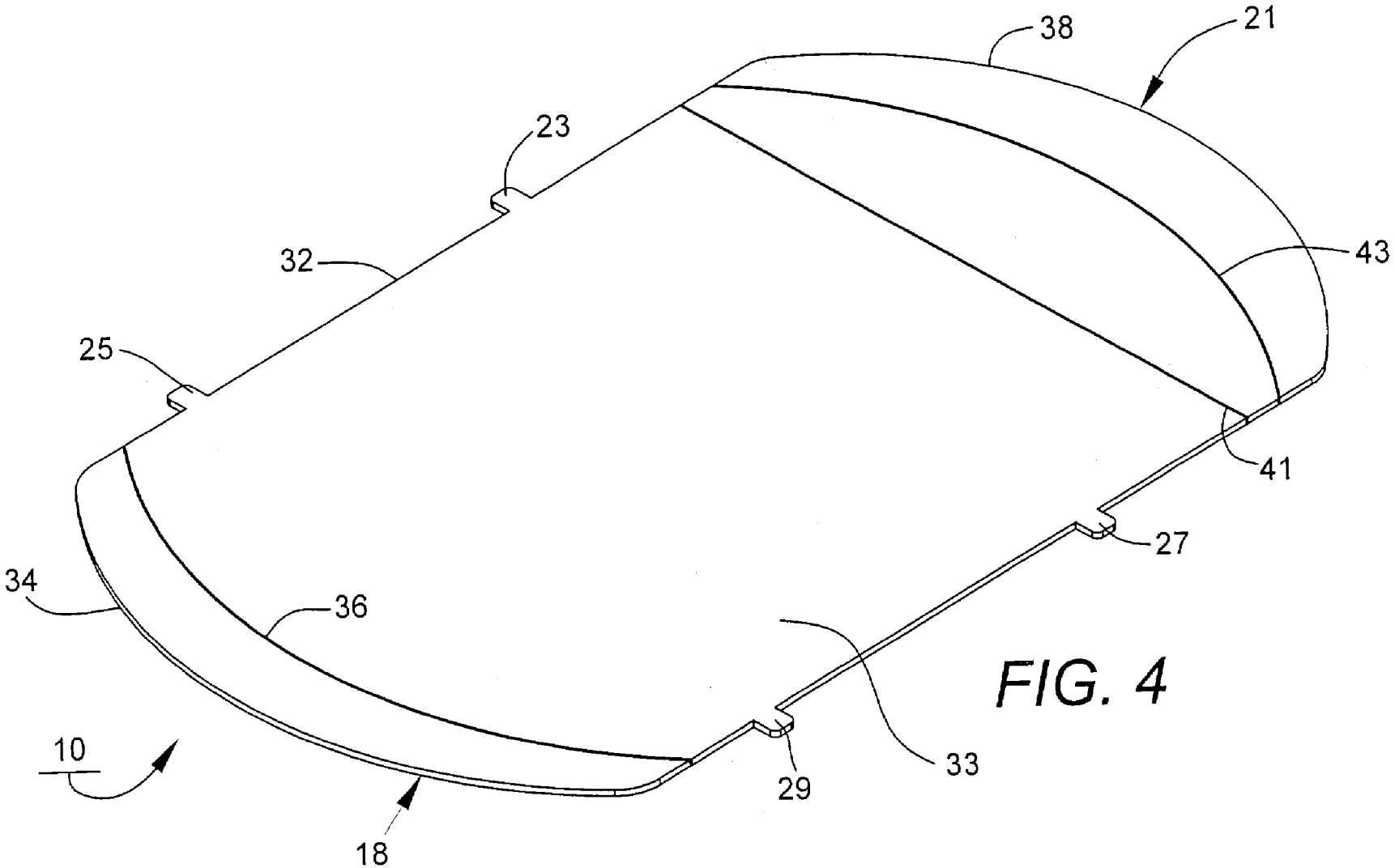
FIG. 4 is a pictorial view of the device of FIG. 1, illustrating it in the unstressed flat condition.
Figure 5:
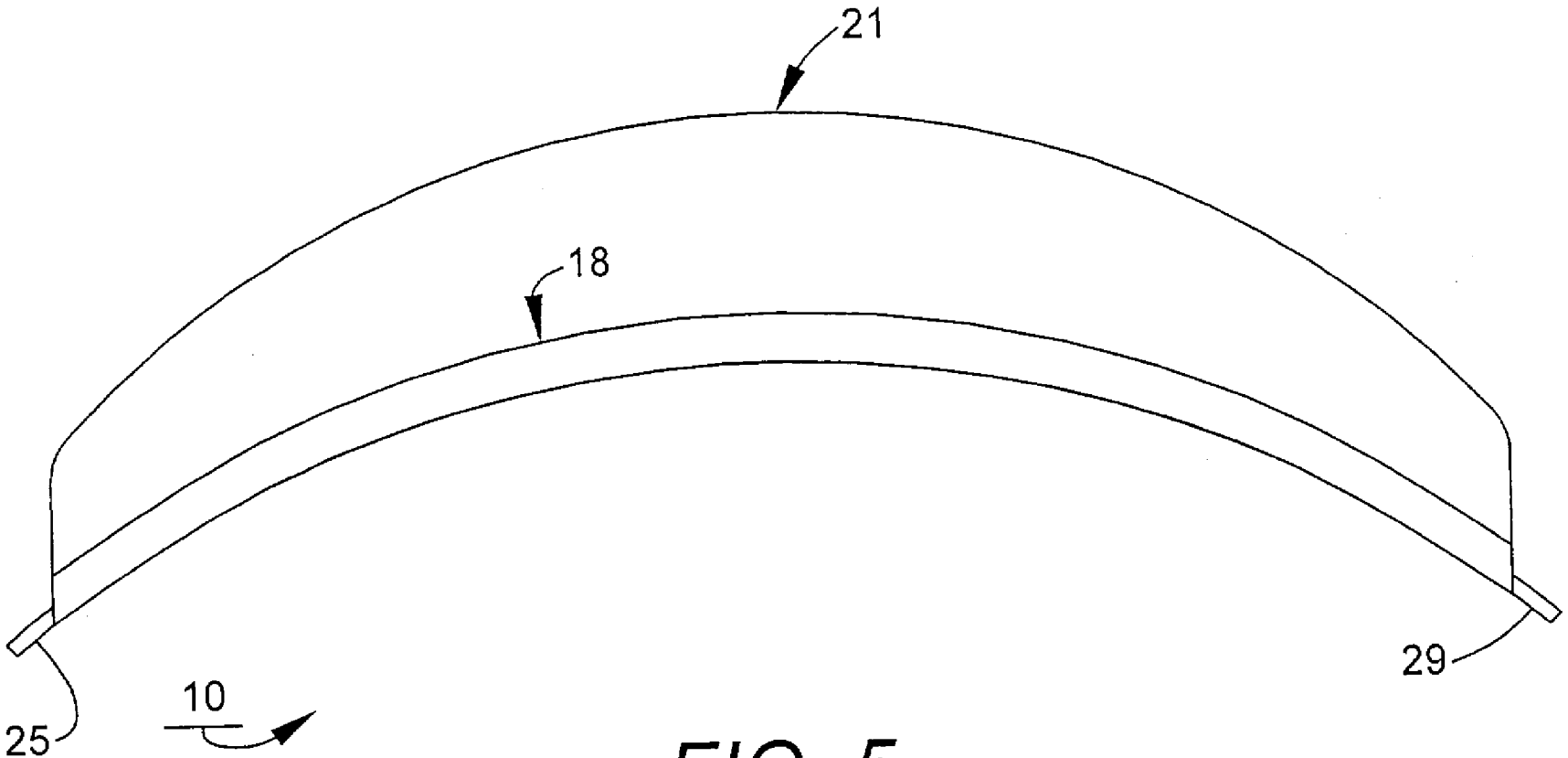
FIG. 5 is a front elevational view of the device of FIG. 1.
Figure 6:
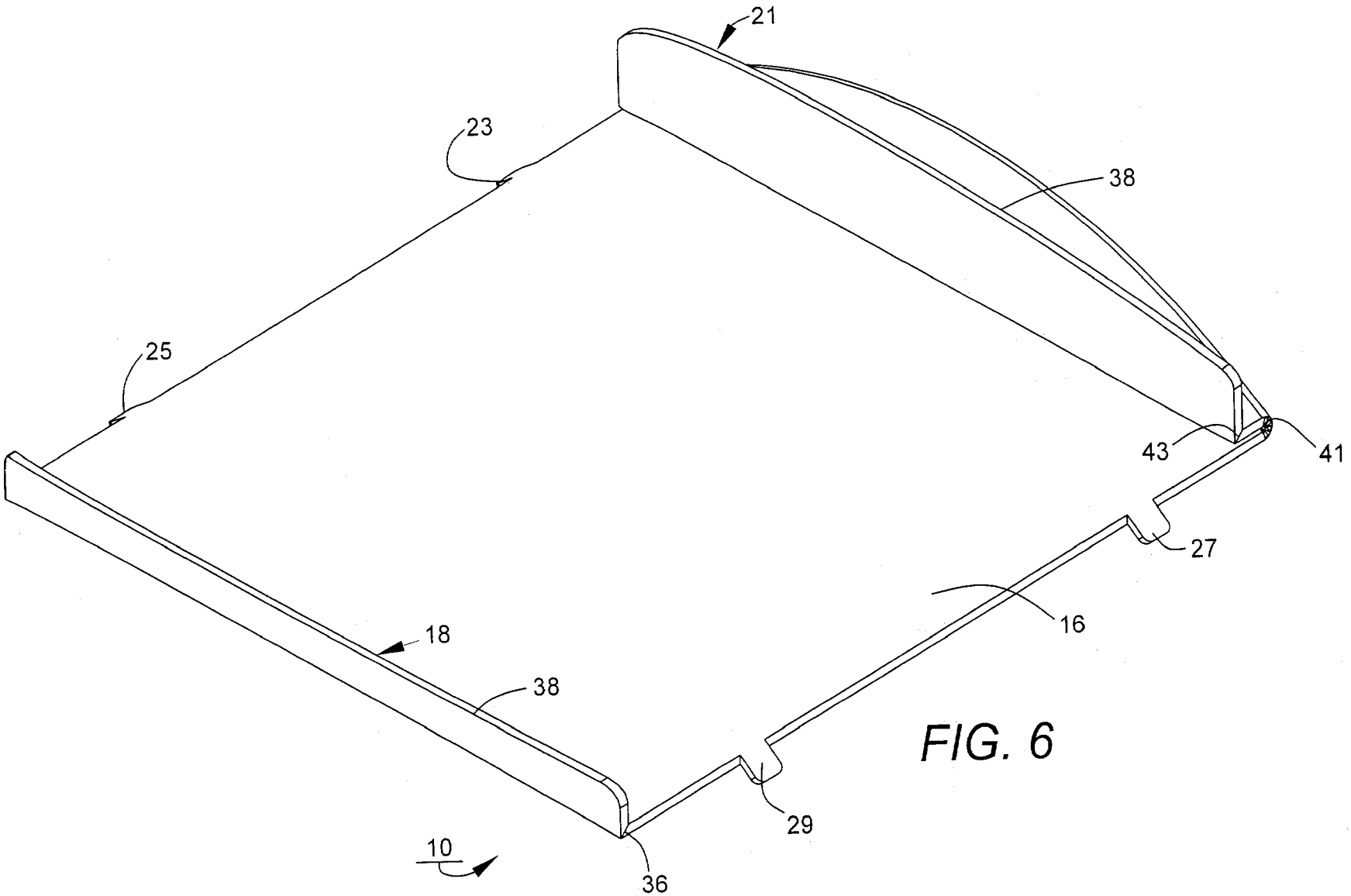
FIG. 6 is a pictorial view of the device of FIG. 1.

As most clearly illustrated in FIG. 3, the storage device 10 may be provided with tabs or ears 23, 25, 27 and 29 on each side for engaging openings (not shown) in the cabinet 12, as an example. Although FIG. 3 illustrates two ears on each side, any appropriate number may be used. For example, it will become apparent to those skilled in the art that only one may be used. Also, other suitable fastening techniques may be used, such as separate pegs, screws, separate molded parts, adhesives, or other techniques.

Thus, a storage device according to the embodiments of the invention, such as the device 10, may be used to support and align elements such as media packages in a simple and clean manner. The curved inclined surface 16 of the media shelf 10 causes only one edge of the base of the media package to contact the curved surface 16. This relationship creates a moment on the element such as a media package, causing the package to lean toward the outside of the curved inclined surface. When an element contacts an upright surface, for example, such as an outer wall of the cabinet 12 or another support structure, the element is held steadily in its upright position. Thus, multiple elements such as media packages may be stored in an organized manner.

Figure 2:
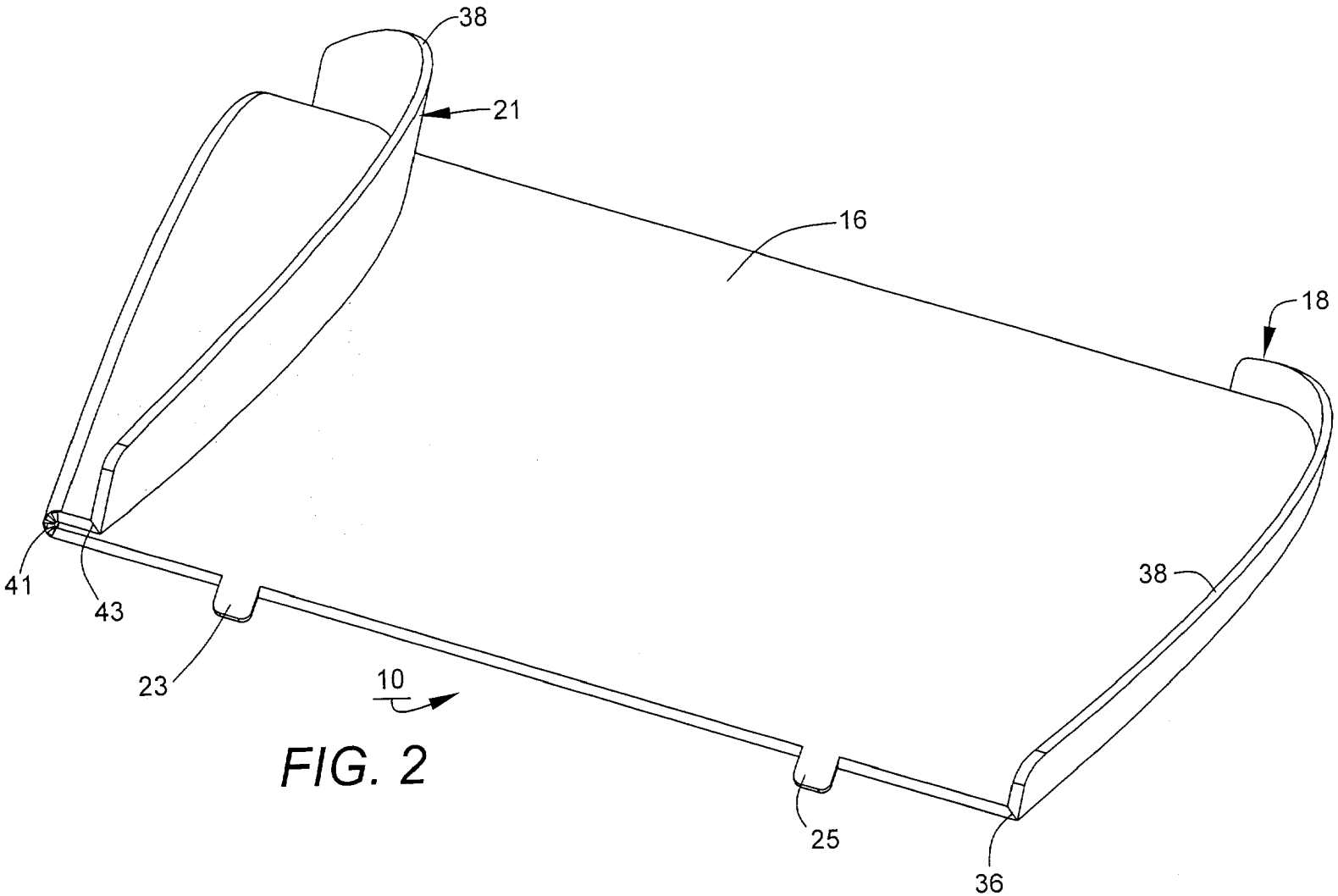
FIGS. 2 and 3 are enlarged pictorial views of the device of FIG. 1, illustrating it in its stressed bowed condition.

The storage device 10 as disclosed herein, is in the form of the flat blank 32 when in its unstressed condition, to enable it to be stored and shipped conveniently in a stacked configuration. In order to assume the configuration as shown in FIGS. 1 through 3, the flanges 18 and 21 are folded upwardly in their upstanding positions, and then the body 33 of the blank 32 is flexed about its longitudinal midplane to form the configuration of FIGS. 1 through 3. The device 10 is retained in its stressed condition when mounted to the support structure.

Considering now, the flange 18 in greater detail, the flange 18 includes a curved edge 34, and is attached to the body 33 by a curved living hinge 36 to permit the flange 18 to assume its upright position.

Considering the flange 21 in greater detail, the flange 21 includes a curved edge 38, and includes a rectilinear transverse living hinge 41 in the blank 32 to enable the flange 21 to be folded reversely over onto itself, and then a curved living hinge 43 disposed between the living hinge 41 and the edge 38 enables the top portion of the flange 21 to be folded into an upright position as shown in FIGS. 1–3 and 5–7. As the body 33 of the blank 32 is flexed about its longitudinal midplane, the flanges 18 and 21 tend to assume their upright positions in a convenient manner.

Figure 7:
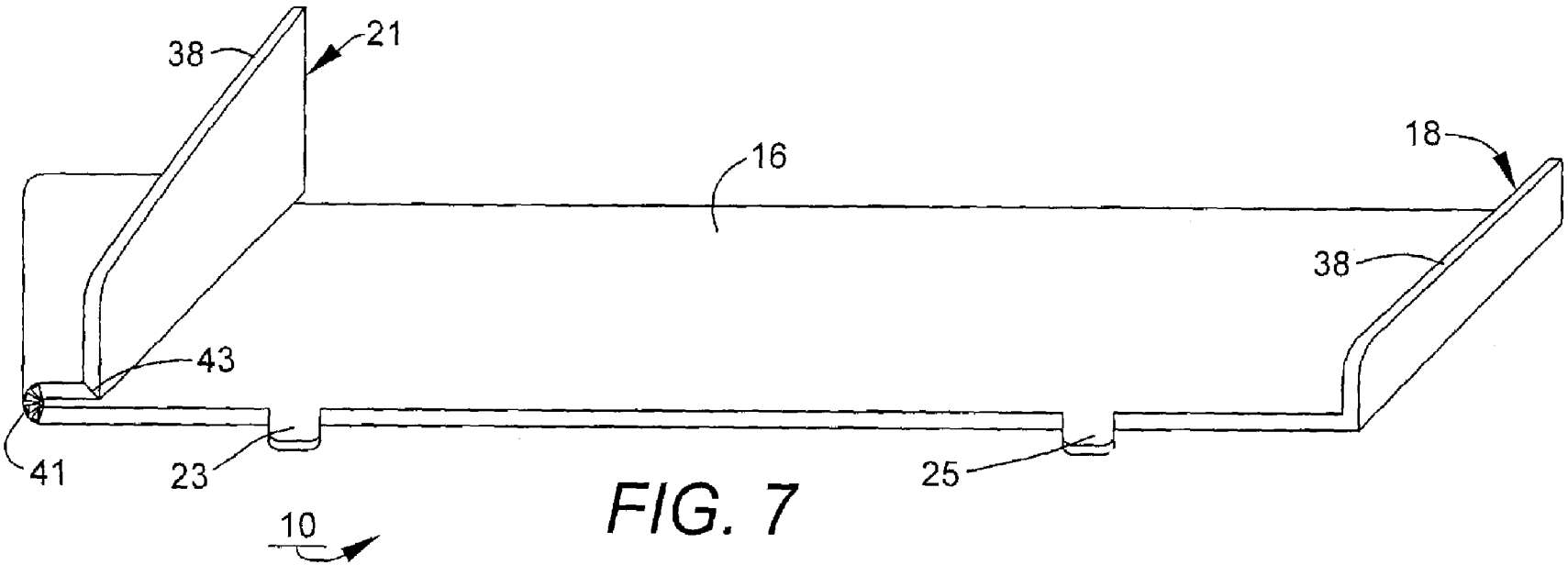
FIG. 7 is an enlarged side elevational view of the device of FIG. 1.
Figure 8:
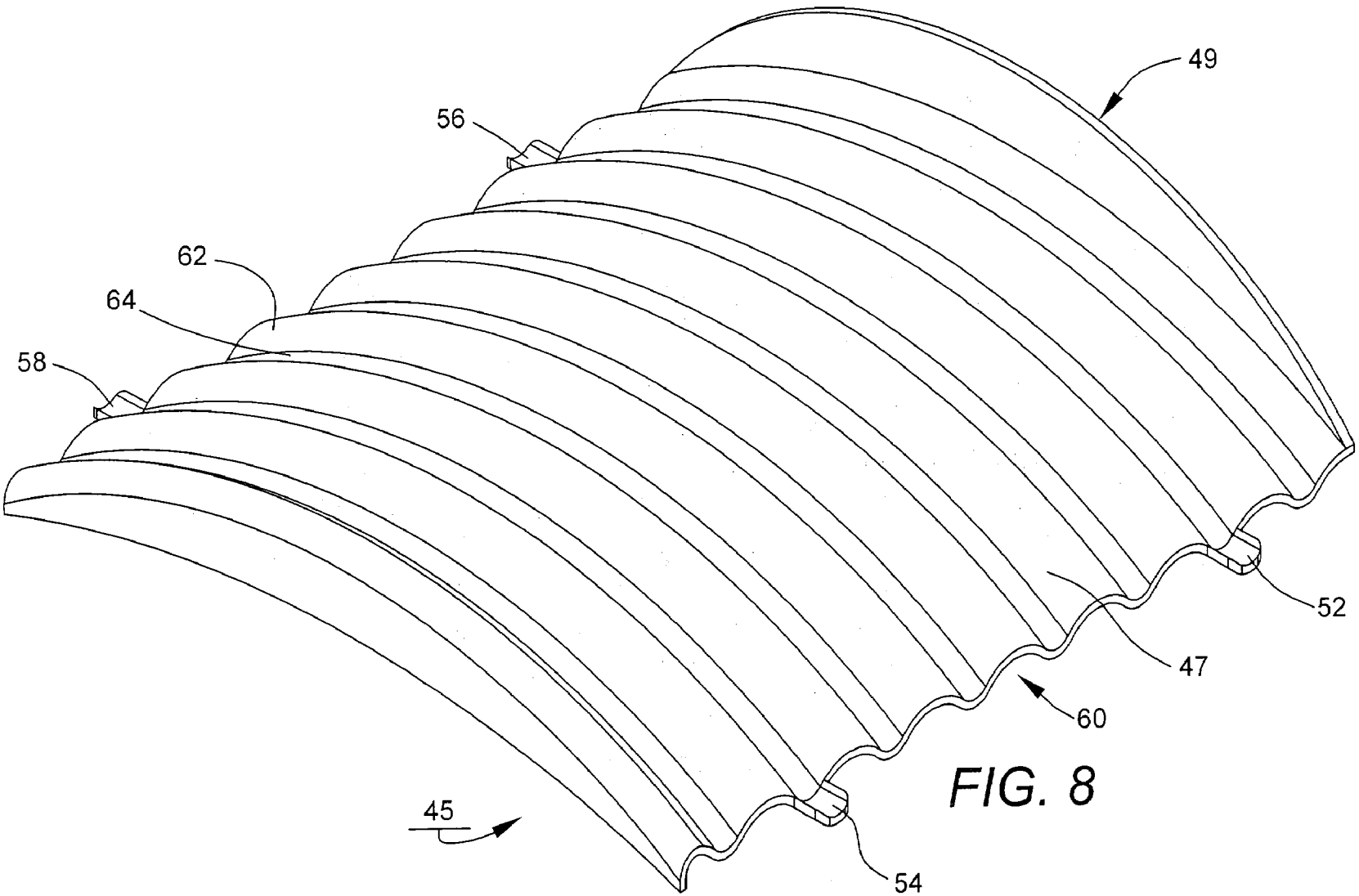
FIG. 8 is a pictorial view of another storage device, which is constructed according to another embodiment of the invention, and which illustrates the tope, rear and right sides thereof.
Figure 9:
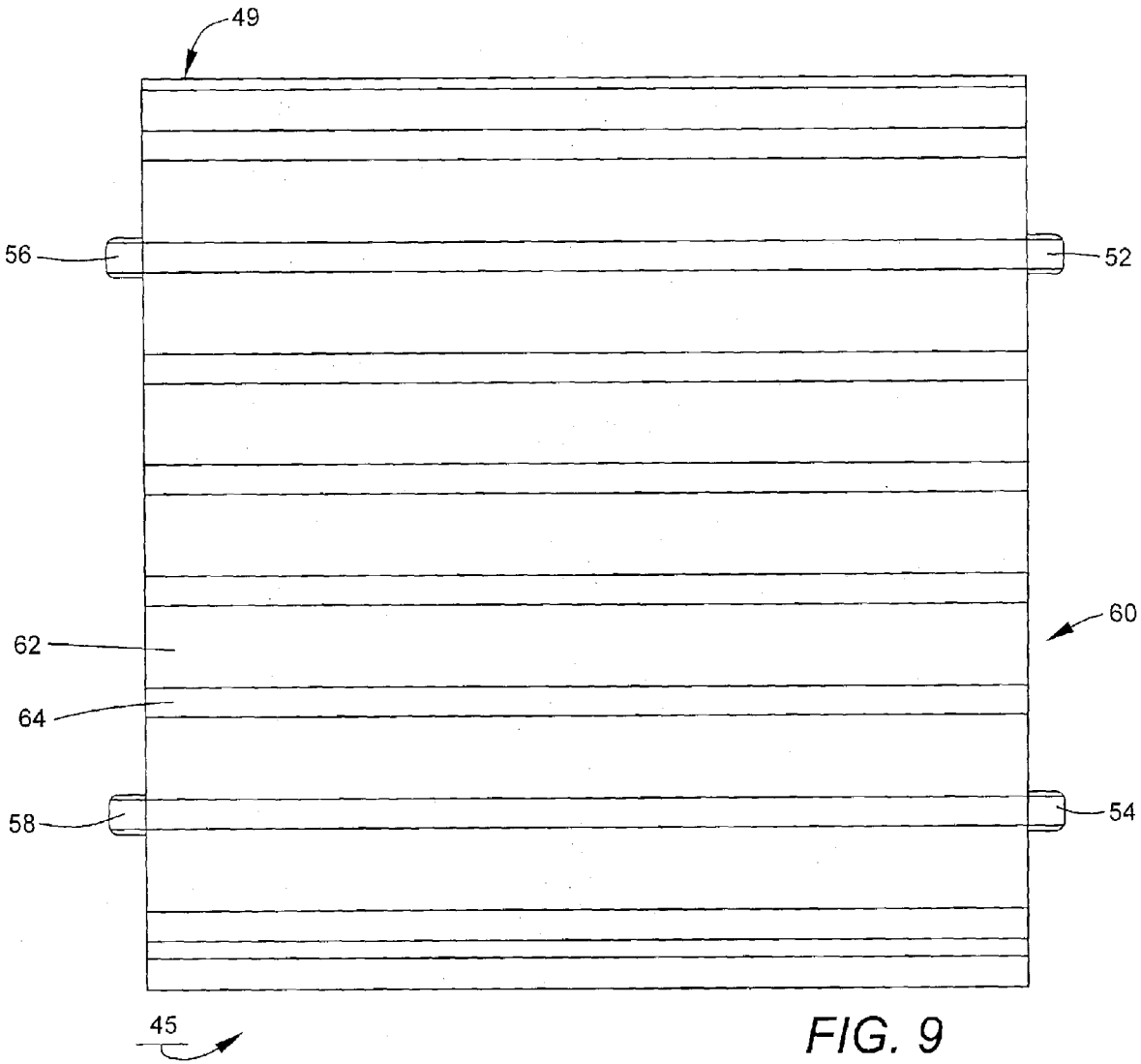
FIG. 9 is an enlarged plan view of the device of FIG. 8.
Figure 10:
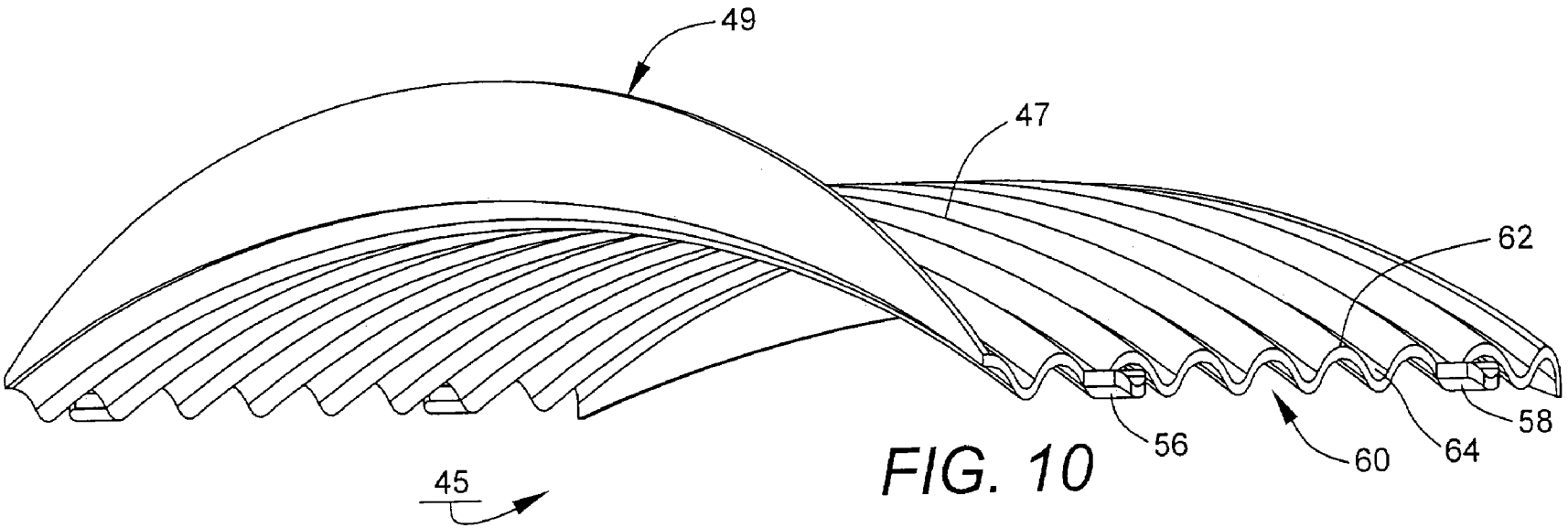
FIG. 10 is a pictorial view of the device of FIG. 8, illustrating the top, front and left side thereof.
Figure 11:
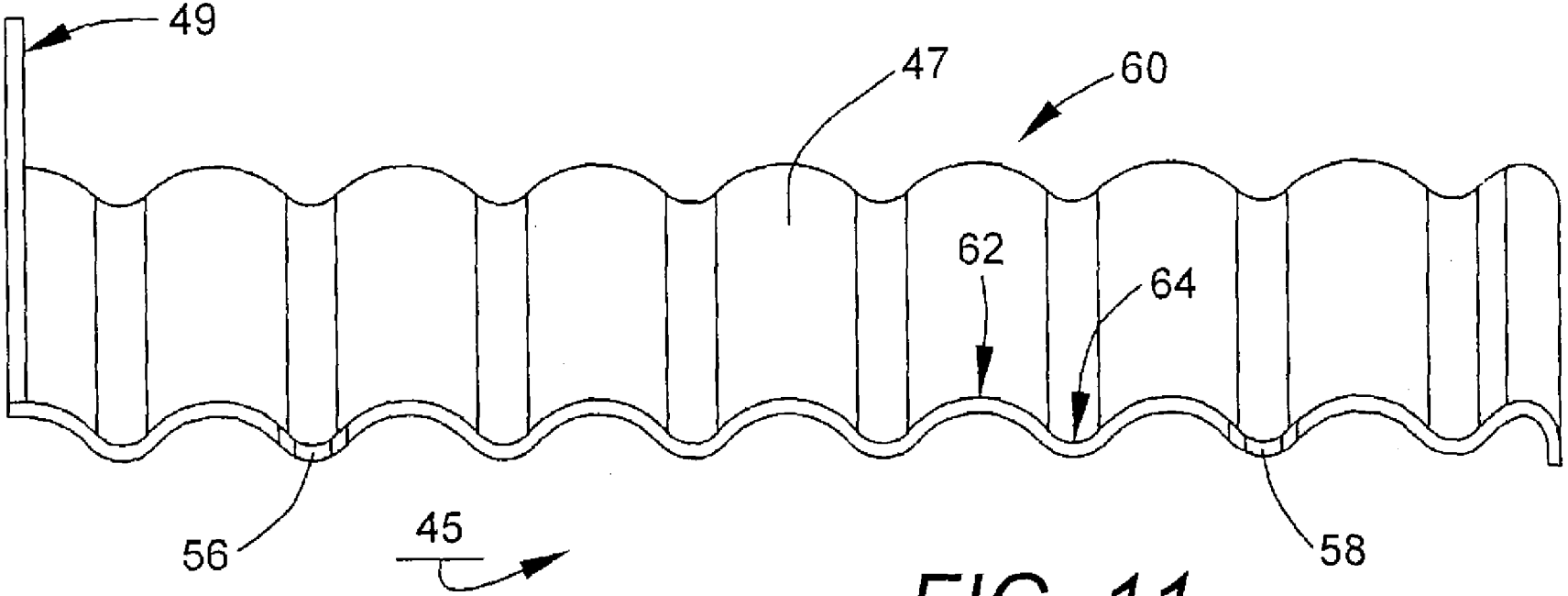
FIG. 11 is a side elevational view of the device of FIG. 8.

As best seen in FIGS. 2 and 7, the rear flange 21 has a curved configuration from front to rear along a longitudinal axis to assume a convex configuration when viewed from the front of the device 10. This configuration helps to urge the elements in an outward orientation in the same way that the inclined surface 16 biases the elements in an outer direction. It will be understood to those skilled in the art that the rear flange can also be disposed in a rectilinear or straight configuration, or it can be curved in a concave manner as viewed from the front of the device 10.

As shown in FIG. 1, there can be a plurality of such storage devices employed in a support structure. For example, the like storage device 13 may also be employed in a spaced-apart configuration relative to the storage device 10. Each one of the storage devices can assume a generally horizontal disposition to serve as a shelf. It is to be understood that the storage devices can be inclined longitudinally relative to the front and rear portions thereof without departing from the spirit of the disclosed embodiments of the present invention. Additionally, it is to be understood that the elements such as media packages being stored in an upright manner can be stored in a variety of orientations. For example, if the element being stored is a book, the spine of the book can face forwardly, upwardly, or in other orientations.

In order to help the blank 32 to flex about its midplane, there can be additional living hinges extending longitudinally along the body 33 to help it to flex. Additionally, living hinges may be provided at the connecting point of the tabs to the body 33.

Referring now to FIGS. 8 through 11, there is illustrated a storage device 45, which is constructed according to another embodiment of the present invention, and which is similar to the device 10 except the device 45 is rigid and corrugated. The device 45 is provided with a curved inclined surface 47 having transverse corrugations 60 thereon. The transverse corrugated surface provides a stiffening effect for additional support for storing elements (not shown) on the device 45. It is to be understood that the corrugations may also extend longitudinally. The device 45 is also provided with a back flange or lip 49 for providing back support for the media elements. Further, tabs or ears 52, 54, 56 and 58 are provided in pairs on each side to secure the device 45 on, for example, a furniture cabinet or other support structure.

The corrugations include a series of peaks such as a peak 62, alternating with a series of valleys or troughs, such as through 64. The elements such as a media package 14 of FIG. 1, rests on top of the peaks such as the peak 62. Thus, the apex of each peak forms a portion of the inclined surface 47 similar to the inclined surface 16 of the device 10. In this regard, the inclined surface 47 formed of a series of spaced apart ridges or apexes of the peaks, is generally upwardly convex in configuration.

Figure 12:
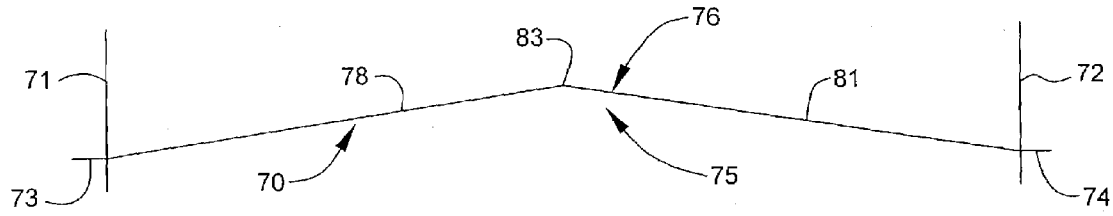
FIG. 12 is a diagrammatic view of yet another storage device, which is constructed in accordance with yet another embodiment of the present invention, and which is shown mounted in a support structure.

Referring now to FIG. 12, there is shown a storage device 70, which is generally similar to the device 10, except that it has a flat inverted v-shape. The device 70 may be supported in a similar manner as the device 10, to a support structure, such as the structure having upright elements 71 and 72 by means of tabs or ears such as tabs 73 and 74. The storage device 70 includes body 75 having an inverted v-shaped inclined surface 76 formed by a pair of inclined flat members 78 and 81 intersecting at an apex 83. Thus, the inverted v-shared inclined surface 76 is similar to the convex inclined surface 16 of the device 10.

Figure 13:
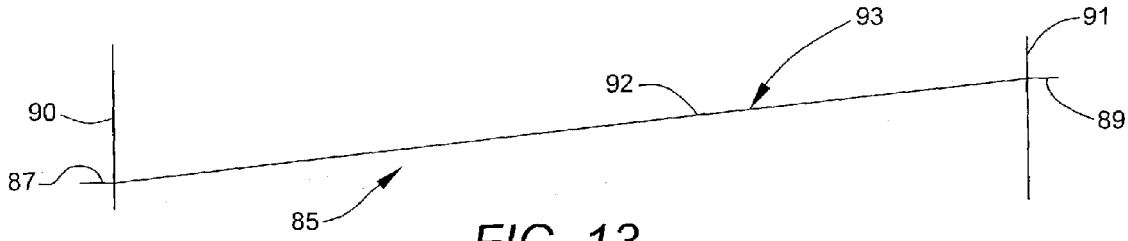
FIG. 13 is a diagrammatic view of still another storage device, which is constructed in accordance with still another embodiment of the present invention, and which is shown mounted in a support structure.

Referring now to FIG. 13, there is shown a storage device 85, which is similar to the device 10, except that the device 85 includes a single flat surface. The device 85 includes pairs of tabs or ears, such as the tabs 87 and 89 for attachment to a support structure such as the support elements 90 and 91.

The device 85 includes a body 93 having an upper flat inclined surface 92 to serve a similar function as the inclined surface 16 of the device 10. In this regard, the body 93 is in the form of a generally flat panel or member.

Figure 14:
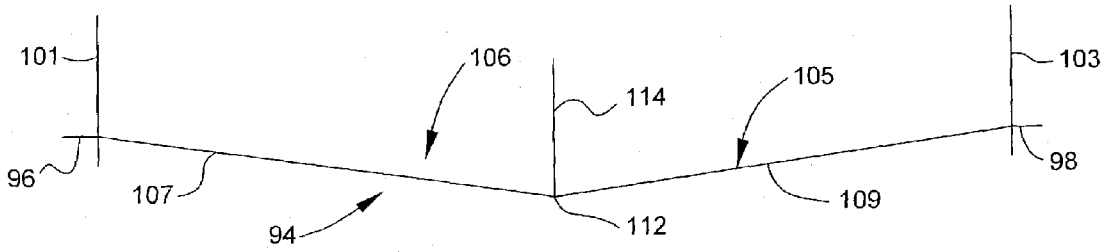
FIG. 14 is a diagrammatic view of a further storage device, which is constructed in accordance with a further embodiment of the present invention, and which is shown mounted in a support structure.

Referring now to FIG. 14, there is disclosed a storage device 94, which is generally similar to the device 10, except that the device 94 is generally V-shaped. The device 94 has a set of tabs such as the tabs 96 and 98 which are used to attached the device 94 to a support structure, such as the support structure elements 101 and 103.

The device 94 includes a V-shaped inclined surface 105 of a body 106. The inclined surface 105 serves a similar function as the inclined surface 16 of the device 10.

The body 106 includes a pair of inclined flat members 107 and 109 which intersect at an apex or bottom-most portion 112. An upstanding support wall or panel 116 is disposed at the apex 112 to provide a vertical surface for elements such as media packages to be supported thereagainst on either side thereof since the side-by-side elements are biased to fall under the force of gravity inwardly toward the support wall 114.

Figure 15:
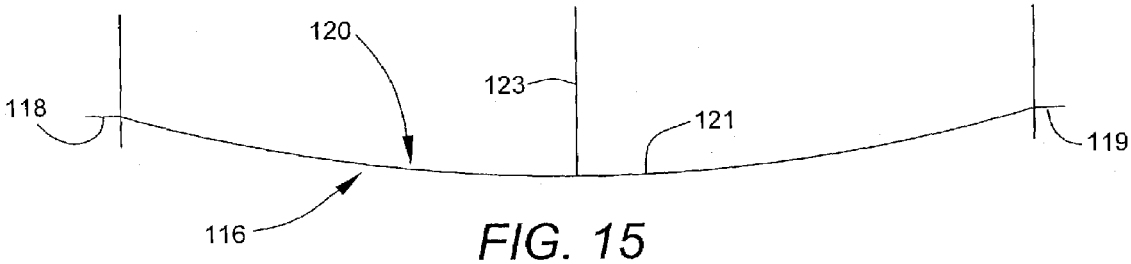
FIG. 15 is a diagrammatic view of yet a further storage device, which is constructed in accordance with yet a further embodiment of the present invention, and which is shown mounted in a support structure.

Referring now to FIG. 15, there is shown a storage device 116, which is generally similar to the device 94, except that the device 116 is smoothly curved in a concave manner. The device 116 includes pairs of tabs or ears, such as the tabs 118 and 119 to mount the device 116 to a support structure. The device 116 includes a body 120 having an upper concave inclined surface 121, which is similar to the surface 105. An upstanding support wall or panel 123 is disposed at the lower most portion of the concave body 120 to serve a similar function as the wall 114.

Figure 16:
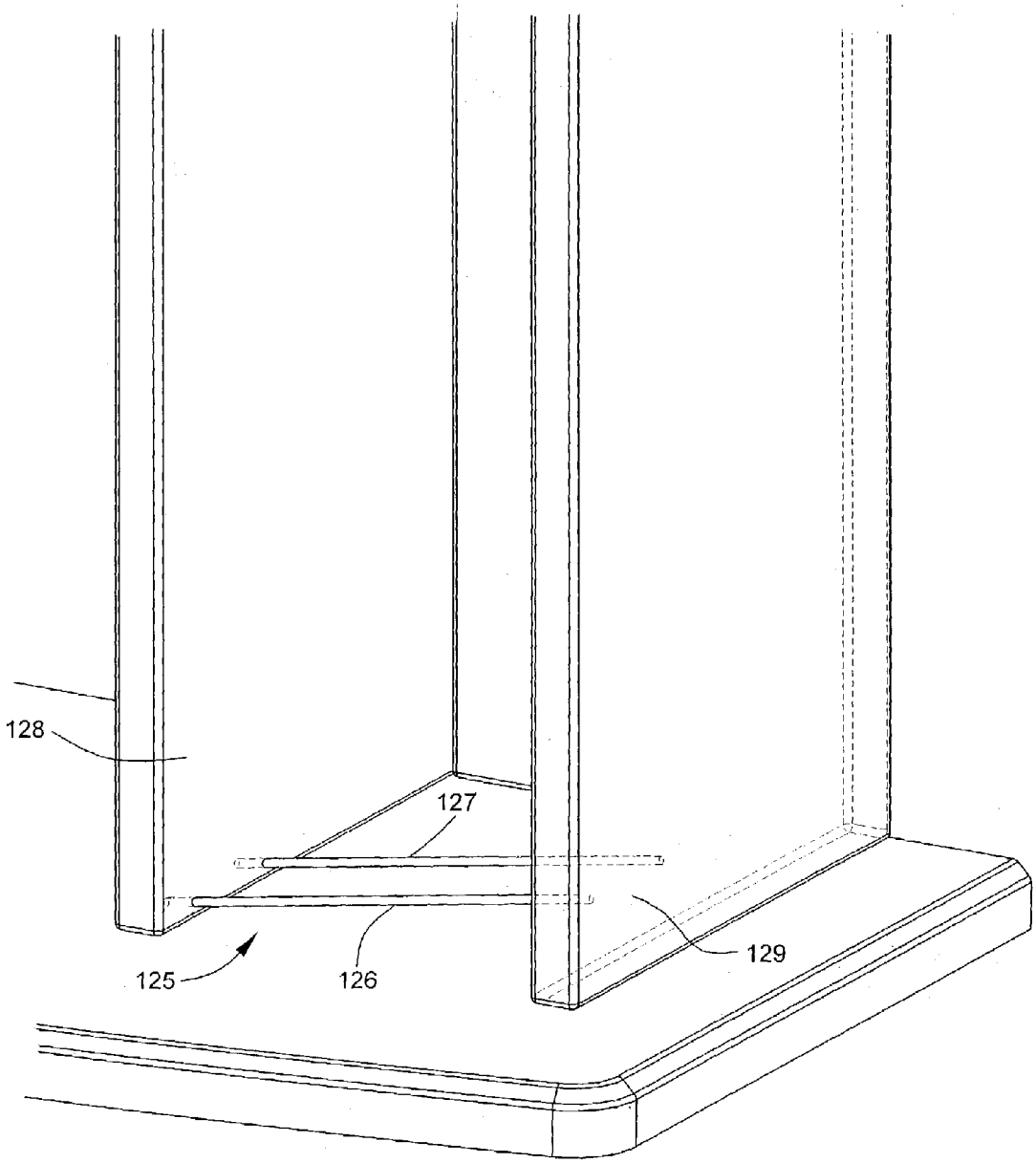
FIG. 16 is a diagrammatic view of still a further storage device, which is constructed in accordance with still a further embodiment of the present invention, and which is shown mounted in a support structure.

Referring now to FIG. 16, there is shown a support device 125, which is similar to the device 10, except that the device 125 is composed of a plurality of elements or members. The support device 125 comprises a group of rods or wires such as the rods 126 and 127, which are disposed in a horizontally spaced-apart manner extending between a pair of upright support structure elements at 128 and 129. Each rod such as the rod 126 extends in a general horizontal disposition, but is inclined between the support structure elements 128 and 129. As shown in FIG. 16, the end of the rod 126 connected to the vertical support structure element 128 is lower than the right hand end portion of the rod 126 connected to the vertical support structure element 129. Thus, the rods 126 and 127 support the elements such as media packages from below in a similar manner as the device 85. The spaced-apart upper surfaces of the rods 126 and 127 form a body having an inclined surface similar to the solid one-piece body 93 of the device 85.

Figure 17:
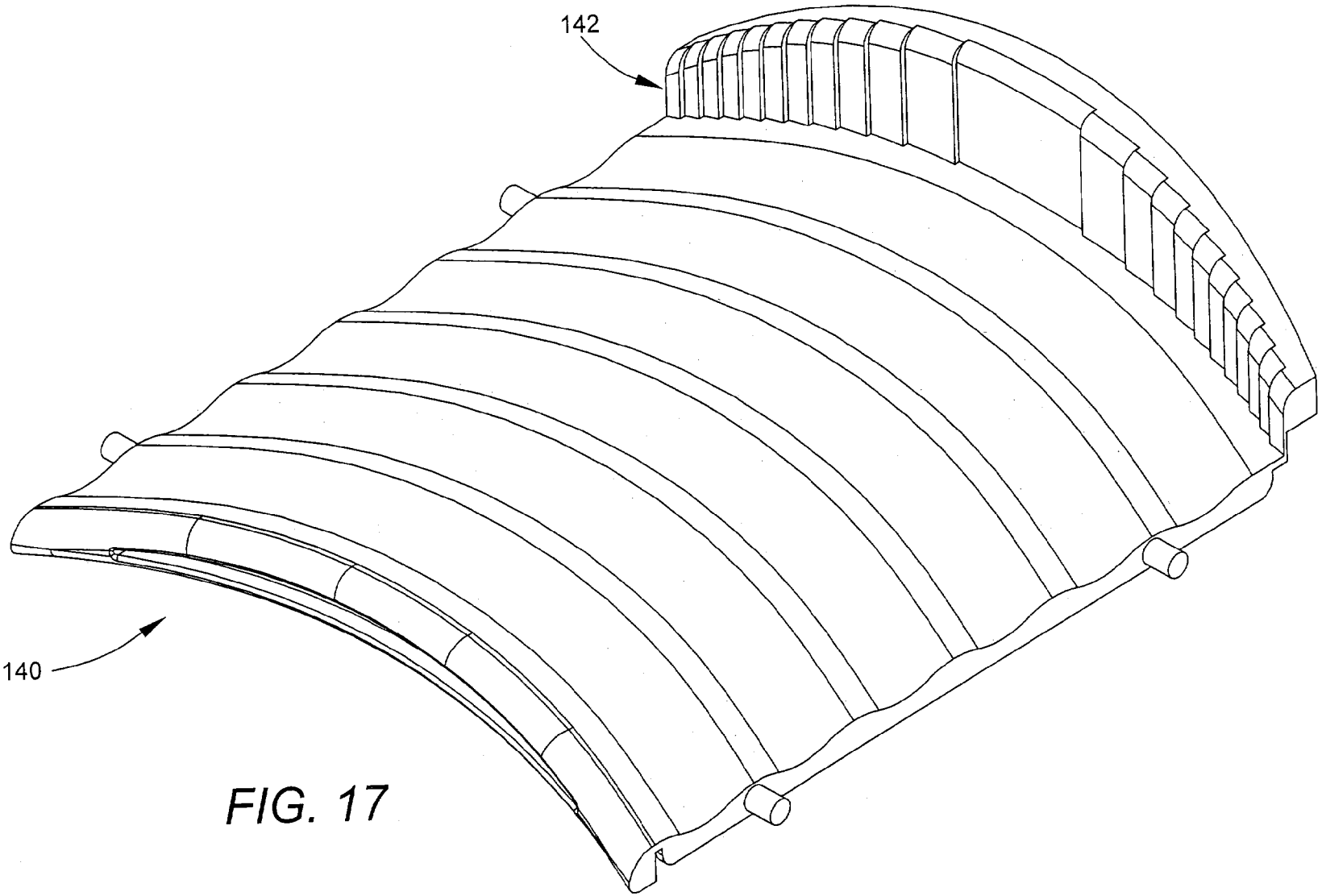
FIG. 17 is a pictorial view of a storage device, which is constructed according to an embodiment of the invention.

Referring now to FIG. 17, there is shown a storage device 140, which is constructed according to an embodiment of the invention, and which is similar to the device 10, except that the rear flange is generally concave. The device 140 includes a series of angled steps 142 on the front face of the rear flange to cause the elements (not shown) to be driven outwardly instead of inwardly, or at least to neutralize the affect of the concave configuration. Such a concave configuration would tend to drive the elements inwardly, and thus the steps counter-act this tendancy.

It should be understood that various ones of the storage devices disclosed herein may be stacked or nested. For example, the storage device 45 can readily stack with like units. In this regard, rigid embodiments of the device of the present invention such as the device 45, can be stored and shipped in a convenient manner due to their stackable design.

With the storage devices disclosed herein having upstanding flanges, the flanges serve as stops and also serve to stiffen or rigidify the devices.

It is understood that the disclosed embodiments of the storage device according to the embodiments of the present invention may be composed of plastic, wood, paper, metal or other suitable material. Further, although certain curved and flat surfaces are illustrated in the embodiments above, it is understood that other configurations are within the scope of the present invention.

While particular embodiments of the present invention have been disclosed, it is to be understood that various different modifications and combinations are possible and are contemplated within the true spirit and scope of the invention. There is no intention, therefore, of limitations to the exact disclosure herein presented.

What is claimed is:

1. A storage device for supporting flat media elements, each having side faces, in upright side-by-side configurations leaning against a generally upright side wall having a face, comprising:

a substantially solid body having an inclined element support surface having front and side edges, the support surface being dimensioned to receive and store the media elements each having their faces extending substantially perpendicular to the support surface front edge in a generally upright configuration and inclined toward the face of the side wall;

wherein the support surface is inclined toward the side wall so that the media elements can rest on the inclined upper surface with the media element faces extending substantially perpendicular to the surface front edge to cause the media elements to be biased under the force of gravity toward the side wall and align the faces of the media elements against one another and supported by the generally upright side wall where the faces of the elements are generally aligned with the face of the upright side wall;

wherein additional media elements can be placed on the support surface in an upright manner and permitted to fall under the force of gravity against previously stored adjacent elements with the faces of the elements engaging one another.

2. A storage device according to claim 1, further including at least one mount for attaching the side edge of said body to the side wall in a generally horizontal disposition.

3. A storage device according to claim 1, wherein said inclined surface is generally upwardly curved in a convex manner.

4. A storage device according to claim 3, wherein said body is bowed about its midplane.

5. A storage device according to claim 1, wherein said inclined surface is generally downwardly curved in a concave manner.

6. A storage device according to claim 5, wherein said body is bowed about its midplane.

7. A storage device according to claim 1, wherein said inclined surface is generally V-shaped having a pair of substantially flat inclined intersecting surfaces.

8. A storage device according to claim 1, wherein said inclined surface has a generally inverted V-shaped configuration having a pair of substantially flat inclined intersecting surfaces.

9. A storage device according to claim 1, wherein said inclined surface is generally flat.

10. A storage device according to claim 1, wherein said body is formed of deformable material capable of being flexed and is generally flat in an unstressed condition and is adapted to be flexed into an inclined condition.

11. A storage device according to claim 1, wherein said body is composed of material selected from the group consisting of plastic, wood, paper and metal.

12. A storage device according to claim 1, wherein said body includes at least one hinge.

13. A storage device according to claim 1, wherein said body includes at least one mounting tab extending from a side edge thereof for engaging an opening in a support structure.

14. A storage device, according to claim 13, wherein at least one of said mounting tabs is connected to said body by a hinge.

15. A storage device according to claim 13, wherein at least one of said mounting tabs is integrally connected to said body.

16. A storage device according to claim 1, further including a first upstanding flange extending transversely on said inclined surface.

17. A storage device according to claim 16, further including a second upstanding flange extending transversely on said inclined surface and spaced from the first upstanding flange.

18. A storage device according to claim 1, wherein said body is corrugated.

19. A storage device according to claim 1, wherein said inclined surface is formed by a plurality of spaced members.

20. A method of supporting flat media elements, each having side faces, in upright side-by-side configurations leaning against a generally upright side wall having a face, comprising:

providing a substantially solid inclined element support having a front edge and having an upper surface being dimensioned to receive and store the media elements each having their faces extending substantially perpendicular to the support surface front edge in a generally upright configuration and inclined toward the face of the side wall;

providing a side edge of the media element support;

connecting the side edge to the generally upright side wall and inclining the upper surface toward the side wall; and positioning a front edge of the support forwardly; and positioning the thin media elements at rest on the inclined upper surface with the media element faces extending substantially perpendicular to the surface front edge to cause the thin media elements to be biased under the force of gravity toward the side wall and align the faces of the media elements against one another and supported by the generally upright side wall where the face of the elements are generally aligned with the face of the upright side wall, wherein additional media elements can be placed on the support surface in an upright manner and permitted to fall under the force of gravity against previously stored adjacent elements with the faces of the elements engaging one another.

21. A method according to claim 20, further including mounting the element support in a generally horizontal disposition to serve as a support shelf.

22. A method according to claim 21, wherein said mounting includes attaching to the side wall by inserting mounting tabs on the element support to openings in the side wall.

23. A method according to claim 21, wherein said mounting includes flexing the element support about its midplane to assume an inclined configuration.

24. A method of making a media storage device for supporting flat media elements, each having side faces, in upright side-by-side configurations leaning against a generally upright side wall having a face, comprising:

providing a body with an substantially solid inclined media element support surface having front and side edges, the body being composed of a material selected from plastic, wood, paper and metal;

providing at least one mount on the media element support on a side edge of the media element support;

the media element support being dimensioned to receive and support a group of the flat media elements each having their faces extending substantially perpendicular to the front edge of the support;

connecting the side edge of the media element support via the mount directly to the generally upright side wall and inclining the upper support surface toward the side wall; and wherein the support surface is inclined toward the side wall so that the media elements can rest on the inclined upper surface with the media element faces extending substantially perpendicular to the surface front edge to cause the media elements to be biased under the force of gravity toward the side wall and align the faces of the media elements against one another and supported by the generally upright side wall where the faces of the elements are generally aligned with the face of the upright side wall; and wherein additional media elements can be placed on the support surface in an upright manner and permitted to fall under the force of gravity against previously stored adjacent elements with the faces of the elements engaging one another.

* * * * *

UNITED STATES PATENT AND TRADEMARK OFFICE

CERTIFICATE OF CORRECTION

PATENT NO. : 6,994,222 B2
APPLICATION NO. : 10/408008
DATED : February 7, 2006
INVENTOR(S) : Thomas Hunt It is certified that error appears in the above-identified patent and that said Letters Patent is hereby corrected as shown below:

Claim 7, column 7, line 44, delete “face” and insert -- faces --.

Signed and Sealed this

Twelfth Day of September, 2006

JON W. DUDAS
*Director of the United States Patent and Trademark Office*